US005636840A

United States Patent [19]

Gardner et al.

[11] Patent Number: 5,636,840

[45] Date of Patent: Jun. 10, 1997

[54] OCCULT DEVICE

[76] Inventors: Mary J. Gardner, 4326 Jefferson St.; Grace L. Abbasi, 6015 Kitty Hawk Dr., both of Riverside, Calif. 92504

[21] Appl. No.: 582,084

[22] Filed: Jan. 2, 1996

[51] Int. Cl.[6] ..... A63F 9/18

[52] U.S. Cl. ..... 273/161; 273/237; 273/157 A

[58] Field of Search ..... 273/153 R, 161, 273/237, 157 A, 243, 287, DIG. 28, DIG. 24

[56] References Cited

U.S. PATENT DOCUMENTS

| | | | |
|---|---|---|---|
| 1,870,677 | 8/1932 | Fuld | 273/161 |
| 3,517,937 | 6/1970 | Glass et al. | 273/157 A |
| 3,675,241 | 7/1972 | Glaser | 340/366 |
| 3,759,607 | 9/1973 | Boyle | 350/293 |
| 3,802,708 | 4/1974 | Libert | 273/237 |
| 3,923,306 | 12/1975 | Cahn-Hidalgo et al. | 273/237 |
| 3,926,439 | 12/1975 | Chao et al. | 273/237 |
| 4,193,213 | 3/1980 | Suda | 35/44 |
| 4,343,474 | 8/1982 | Caney | 273/237 |
| 4,799,680 | 1/1989 | Weimar | 273/157 A |
| 4,953,864 | 9/1990 | Katz | 273/161 |
| 5,203,564 | 4/1993 | Bruzas et al. | 273/161 |

*Primary Examiner*—Steven B. Wong

*Attorney, Agent, or Firm*—Richard L. Miller, P.E.

[57] ABSTRACT

An occult device that includes an open-top hollow rectangular box, a light source, a first light transmitting sheet, a second light transmitting sheet, and an indicator. The open-top hollow rectangular box has a pair of long sides, a pair of short sides, a closed bottom, and an open top. The light source is disposed in the open-top hollow rectangular box. The first light transmitting sheet is disposed on the open top of the open-top hollow rectangular box, so that light from the light source can be transmitted therethrough. The second light transmitting sheet is disposed on the open top of the open-top hollow rectangular box and supported by the first light transmitting sheet, so that light from the light source can be transmitted therethrough. The first light transmitting sheet and the second light transmitting sheet close the open top of the open-top hollow rectangular box. And, the indicator is movable on the second light transmitting sheet by the hands of a user.

16 Claims, 1 Drawing Sheet

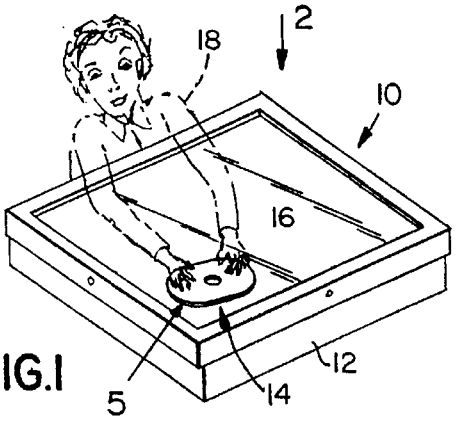
FIG.1
FIG.4
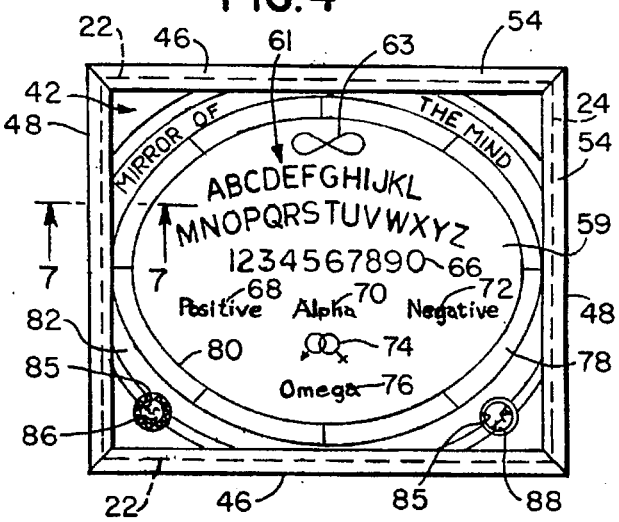
FIG.2
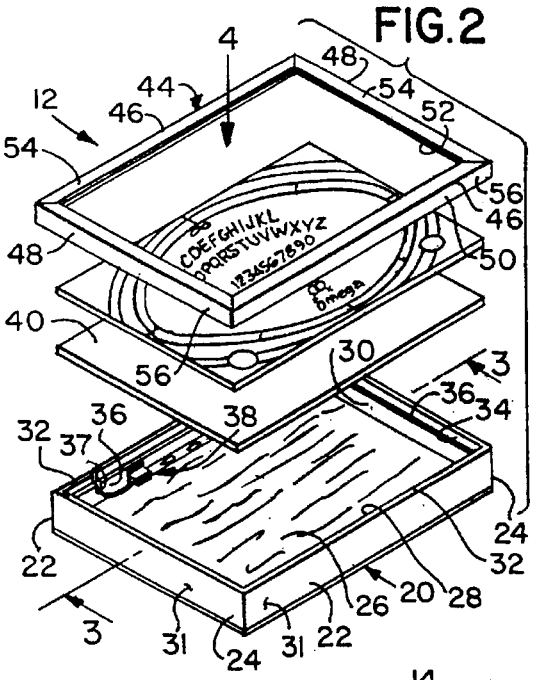
FIG.3
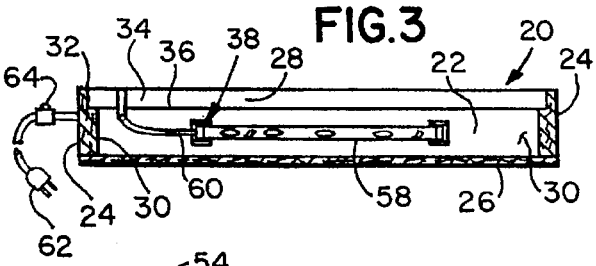
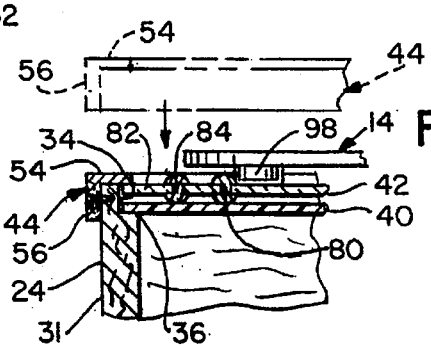
FIG.7
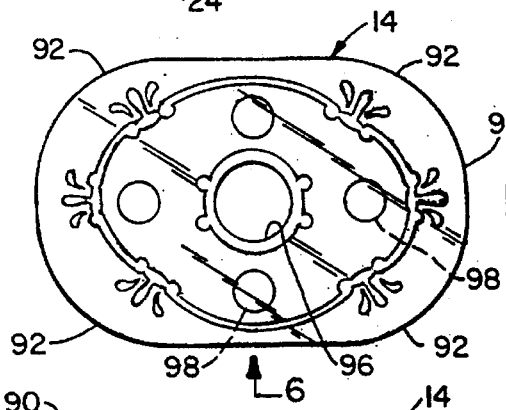
FIG.5
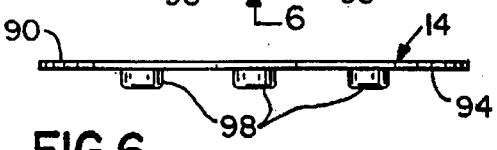
FIG.6

OCCULT DEVICE

CROSS REFERENCE TO RELATED APPLICATIONS

The instant application contains subject matter disclosed in applicant's Disclosure Document No. 381675 filed Aug. 24, 1995. As such, it is respectfully requested that said Disclosure Document remain a permanent part of the file history and be relied upon during the prosecution of the instant application and for any other matters that may arise.

BACKGROUND OF THE INVENTION

The present invention relates to an occult device. More particularly, the present invention relates to an occult device that includes a hollow open-top box, an elliptical mirror containing light communicating etched printed matter that is disposed at the open top of the hollow open-top box, stained glass surrounding the elliptical mirror, a light source disposed in the hollow open-top box, and an indicator movable on the elliptical mirror.

Chance-controlled question and answer devices have been known heretofore. In many such prior arrangements, a chance-controlled indicator is utilized to select a symbol which may be used to access coded source materials.

One type utilizes a rotatable pointer adapted for chance registration with one of a plurality of radial sectors formed on a game board. Each sector has a unique symbol associated with it which is used together with a deck of cards and an associated book of answers as a guide to ascertain the answer to a question posed.

Another type utilizes a chance-controlled mechanism used with a book that has a series of coded questions and answers. The chance-controlled mechanism consists of a receptacle provided with a ball-mixing chamber and a plurality of ball pockets in which balls from the ball-mixing chamber are received in a file or row. The balls are colored so as to portray a pattern obtained by chance which corresponds to one of the coded answers.

Finally, still another type utilizes a plurality of magnetized game pieces that are inserted one at a time on top of each other into each of a plurality of cylindrical bores formed in a piece holder block. The length of each stacked row of game pieces formed varies depending upon whether individual pieces within each of the bores are subject to magnetic attraction or repulsion acting between the opposed ends of the pieces.

Numerous innovations for occult devices have been provided in the prior art that will be described. However, even though these innovations may be suitable for the specific individual purposes to which they address, they differ from the present invention in that they do not teach an occult device that includes a hollow open-top box, an elliptical mirror containing light communicating etched printed matter that is disposed at the open top of the hollow open-top box, stained glass surrounding the elliptical mirror, a light source disposed in the hollow open-top box, and an indicator movable on the elliptical mirror.

For example, U.S. Pat. No. 3,675,241 to Glaser teaches a display system that includes a crystal ball that has an operating circuit coupled thereto. The operating circuit includes electrode means in operative relation with the crystal ball and adapted to be energized by proximity or contact with the hands of an operator.

Another example, U.S. Pat. No. 3,759,607 to Boyle teaches an occult illuminator system that includes a hollow chamber with window means. The interior of the hollow chamber is lined with reflective material of which at least one half is crinkled metal foil.

Still another example, U.S. Pat. No. 4,193,213 to Suda teaches an astrological fortune-telling device that includes a base plate having twelve houses, a rotatable plate provided with the twelve depicted constellation signs, orbits for placement of markings corresponding to planets, a transparent cover, and a transparent rotatable disk provided with fan-shape areas.

Yet another example, U.S. Pat. No. 4,953,864 to Katz teaches an I-Ching that includes indistinguishable bar magnets selected in random and brought into proximity, allowing the magnetic poles of the magnets, so juxtaposed, to exhibit attraction or repulsion.

Finally, still yet another example, U.S. Pat. No. 5,203,564 to Katz Bruzas et al. teaches an occult device that includes a board surface and a pointer device. The board surface has a plurality of mystic symbols surrounded by a first circular field of numbers that is further surrounded by a ring field of I-Ching hexagrams.

It is apparent that numerous innovations for occult devices have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Accordingly, an object of the present invention is to provide an occult device that avoids the disadvantages of the prior art.

Another object of the present invention is to provide an occult device that is simple and inexpensive to manufacture.

Still another object of the present invention is to provide an occult device that is simple to use.

Yet another object of the present invention is to provide an occult device that may be used by one to four persons to instantly coax the power of the mind to communicate in clear understandable messages.

Still yet another object of the present invention is to provide an occult device that when used in the proper setting, that is, in a quiet dark room with perhaps a little music and candlelight, any believer with a little patience can receive not only answers to questions but may also solve problems, break creative blocks, or gain self confidence to perform stressful or difficult tasks.

Yet still another object of the present invention is to provide an occult device that with a little faith each believer's inner psychic is open to receive inquiries or requests.

Still yet another object of the present invention is to provide an occult device that is not only a beautiful work of art but enhances the ability of the users to induce a state of consciousness similar to self hypnosis due to the enchanting illuminated effect of the letters, numbers, and symbols on the mirror's surface.

Briefly stated, yet still another object of the present invention is to provide an occult device that includes an open-top hollow rectangular box, a light source, a first light transmitting sheet, a second light transmitting sheet, and an indicator.

Still yet another object of the present invention is to provide an occult device wherein the open-top hollow rectangular box has a pair of long sides, a pair of short sides, a closed bottom, and an open top.

Yet still another object of the present invention is to provide an occult device wherein the light source is disposed in the open-top hollow rectangular box.

Still yet another object of the present invention is to provide an occult device wherein the first light transmitting sheet is disposed on the open top of the open-top hollow rectangular box, so that light from the light source can be transmitted therethrough.

Yet still another object of the present invention is to provide an occult device wherein the second light transmitting sheet is disposed on the open top of the open-top hollow rectangular box and supported by the first light transmitting sheet, so that light from the light source can be transmitted therethrough.

Still yet another object of the present invention is to provide an occult device wherein the first light transmitting sheet and the second light transmitting sheet close the open top of the open-top hollow rectangular box.

Yet still another object of the present invention is to provide an occult device wherein the indicator is movable on the second light transmitting sheet by the hands of a user.

Still yet another object of the present invention is to provide an occult device wherein the open-top hollow rectangular box is oak wood.

Yet still another object of the present invention is to provide an occult device wherein each of the pair of long sides of the open-top rectangular box and each of the pair of short sides of the open-top rectangular box has an inner surface, an outer surface, and a top.

Still yet another object of the present invention is to provide an occult device wherein the inner surface of each of the pair of long sides of the open-top rectangular box and of each of the pair of short sides of the open-top rectangular box has a recess disposed in proximity to the top of each of the pair of long sides of the open-top rectangular box and in proximity to the top of each of the pair of short sides of the open-top rectangular box.

Yet still another object of the present invention is to provide an occult device wherein the recess of the inner surface of each of the pair of long sides of the open-top rectangular box and of each of the pair of short sides of the open-top rectangular box in communication with each other and open into the open top of the open-top rectangular box so as to form a continuous ledge.

Still yet another object of the present invention is to provide an occult device wherein a rearmost one of the pair of long sides of the open-top rectangular box has a vertically disposed slot disposed therethrough in proximity to a one of the pair of short sides of the open-top rectangular box.

Yet still another object of the present invention is to provide an occult device wherein the light source is mounted on the inner surface of the rearmost one of the pair of long sides of the open-top rectangular box.

Still yet another object of the present invention is to provide an occult device wherein the first rectangular light transmitting sheet is disposed in the recess of the inner surface of each of the pair of long sides of the open-top rectangular box and of each of the pair of short sides of the open-top rectangular box and rests on the continuous ledge of the open-top rectangular box.

Yet still another object of the present invention is to provide an occult device wherein the first rectangular light transmitting sheet is acrylic.

Still yet another object of the present invention is to provide an occult device wherein the second rectangular light transmitting sheet is disposed in the recess of the inner surface of each of the pair of long sides of the open-top rectangular box and of each of the pair of short sides of the open-top rectangular box and rests on the first rectangular light transmitting sheet.

Yet still another object of the present invention is to provide an occult device that further includes an open-bottom open-top rectangular top frame that has a pair of right angled long sides, a pair of right angled short sides, an open bottom, and an open top.

Still yet another object of the present invention is to provide an occult device wherein each of the pair of right angled long sides of the open-bottom open-top rectangular top frame and each of the pair of right angled short sides of the open-bottom open-top rectangular top frame has a horizontal portion and a vertical portion that extends perpendicularly downwardly from the horizontal portion of the open-bottom open-top rectangular top frame.

Yet still another object of the present invention is to provide an occult device wherein the open-bottom open-top rectangular top frame is oak wood.

Still yet another object of the present invention is to provide an occult device wherein the open-bottom open-top rectangular top frame is disposed on the open-top hollow rectangular box with the horizontal portion of each of the pair of right angled long sides of the open-bottom open-top rectangular top frame and each of the pair of right angled short sides of the open-bottom open-top rectangular top frame resting on the top of each of the pair of long sides of the open-top rectangular box and of each of the pair of short sides of the open-top rectangular box and with the vertical portion of each of the pair of right angled long sides of the open-bottom open-top rectangular top frame and each of the pair of right angled short sides of the open-bottom open-top rectangular top frame abutting the outer surface of each of the pair of long sides of the open-top rectangular box and of each of the pair of short sides of the open-top rectangular box, so that both the first rectangular light transmitting sheet and the second rectangular light transmitting sheet are secured in the recess of the inner surface of each of the pair of long sides of the open-top rectangular box and of each of the pair of short sides of the open-top rectangular box.

Yet still another object of the present invention is to provide an occult device wherein the light source is a 120 volt 7 watt light bulb.

Still yet another object of the present invention is to provide an occult device that further includes an electrical cord that extends from the light bulb through the vertically disposed slot of the rearmost one of the pair of long sides of the open-top rectangular box.

Yet still another object of the present invention is to provide an occult device wherein the electrical cord terminates in an electrical plug.

Still yet another object of the present invention is to provide an occult device wherein the electrical cord contains an electrical on/off switch that is disposed external to the open-top rectangular box and in proximity to the vertically disposed slot of the rearmost one of the pair of long sides of the open-top rectangular box, so that power from a 120 volt power source can be controlled and when the electrical on/off switch is closed power from the power source passes through the electrical cord and illuminates the light bulb.

Yet still another object of the present invention is to provide an occult device wherein the second rectangular light transmitting sheet includes a centrally disposed elliptical mirror.

Still yet another object of the present invention is to provide an occult device wherein the centrally disposed elliptical mirror of the second rectangular light transmitting sheet has etched printed matter disposed thereon, so that when the light bulb is illuminated the etched printed matter of the centrally disposed elliptical mirror of the second rectangular light transmitting sheet becomes visible.

Yet still another object of the present invention is to provide an occult device wherein the etched printed matter of the centrally disposed elliptical mirror of the second rectangular light transmitting sheet includes an infinity sign, the twenty-six letters of the alphabet, the numbers 1 to 0, the word "positive", the word "Alpha", the word "Negative", a male and female sign joined in harmony, and the word "Omega".

Still yet another object of the present invention is to provide an occult device wherein the second rectangular light transmitting sheet further includes a copper or silver foiled colorful stained glass elliptical ring that is concentrically attached to, and surrounds, the centrally disposed elliptical mirror of the second rectangular light transmitting sheet by a first solder ring.

Yet still another object of the present invention is to provide an occult device wherein the first solder ring of the second rectangular light transmitting sheet is thicker than the centrally disposed elliptical mirror of the second rectangular light transmitting sheet, so that the first solder ring of the second rectangular light transmitting sheet rests on the first rectangular light transmitting sheet and the centrally disposed elliptical mirror of the second rectangular light transmitting sheet is displaced a distance above the first rectangular light transmitting sheet and since the first solder ring of the second rectangular light transmitting sheet is thicker than the centrally disposed elliptical mirror of the second rectangular light transmitting sheet, on which the movable indicator moves, the boundary of movement of the movable indicator is defined preventing the movable indicator from unintentionally falling off the occult device.

Still yet another object of the present invention is to provide an occult device wherein the second rectangular light transmitting sheet further includes a copper or silver foiled colorful stained glass filler section attached to the copper or silver foiled colorful stained glass elliptical ring of the second rectangular light transmitting sheet by a second solder ring.

Yet still another object of the present invention is to provide an occult device wherein the copper or silver foiled colorful stained glass filler section of the second rectangular light transmitting sheet fills in the remaining space of the second rectangular light transmitting sheet.

Still yet another object of the present invention is to provide an occult device wherein the second solder ring of the second rectangular light transmitting sheet is substantially as thick as the first solder ring of the second rectangular light transmitting sheet and also rests on the first rectangular light transmitting sheet.

Yet still another object of the present invention is to provide an occult device wherein the copper or silver foiled colorful stained glass filler section of the second rectangular light transmitting sheet has a pair of apertures.

Still yet another object of the present invention is to provide an occult device wherein the copper or silver foiled colorful stained glass filler section of the second rectangular light transmitting sheet further has a first stained glass insert that fills one of the pair of filler section apertures of the copper or silver foiled colorful stained glass filler section of the second rectangular light transmitting sheet, the first stained glass insert of the copper or silver foiled colorful stained glass filler section of the second rectangular light transmitting sheet has a moon etched thereon, so that when the light bulb is illuminated the etched moon becomes visible.

Yet still another object of the present invention is to provide an occult device wherein the copper or silver foiled colorful stained glass filler section of the second rectangular light transmitting sheet further has a second stained glass insert that fills another one of the pair of filler section apertures of the copper or silver foiled colorful stained glass filler section of the second rectangular light transmitting sheet.

Still yet another object of the present invention is to provide an occult device wherein the first stained glass insert of the copper or silver foiled colorful stained glass filler section of the second rectangular light transmitting sheet has a sun etched thereon, so that when the light bulb is illuminated the etched sun becomes visible.

Yet still another object of the present invention is to provide an occult device wherein the movable indicator includes a substantially rectangular body that has rounded corners, a lower surface, four legs that extend downwardly from the lower surface of the rectangular body of the movable indicator, and a centrally disposed circular throughbore, so that when the light bulb is illuminated the etched printed matter of the centrally disposed elliptical mirror of the second rectangular light transmitting sheet is visible through the centrally disposed circular throughbore of the substantially rectangular body of the movable indicator.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view illustrating the present invention being utilized by a user;

FIG. 2 is an exploded diagrammatic perspective view of the stationary box portion of the present invention indicated by arrow 2 in FIG. 1;

FIG. 3 is a cross sectional view taken on line 3—3 in FIG. 2;

FIG. 4 is a diagrammatic top plan view taken in the direction of arrow 4 in FIG. 2;

FIG. 5 is an enlarged diagrammatic top plan view of the movable indicator portion of the present invention indicated by arrow 5 in FIG. 1;

FIG. 6 is a diagrammatic side elevational view taken in the direction of arrow 6 in FIG. 5; and FIG. 7 is a cross sectional view taken on line 7—7 in FIG. 4 showing the interrelationship of the movable indicator portion and the stationary box portion.

LIST OF REFERENCE NUMERALS UTILIZED IN THE DRAWING

10 occult device of the present invention

12 stationary box portion

14 movable indicator portion
16 user hands
18 user
20 open-top hollow rectangular box
22 pair of box long sides
24 pair of box short sides
26 box closed bottom
28 box open top
30 box side inner surface
31 box side outer surface
32 box side top
34 box recess
36 box continuous ledge
37 box long side vertically disposed slot
38 light source arrangement
40 first rectangular light transmitting sheet
42 second rectangular light transmitting sheet
44 open-bottom open-top rectangular top frame
46 pair of top frame right angled long sides
48 pair of top frame angled short sides
50 top frame open bottom
52 top frame open top
54 top frame horizontal portion
56 top frame vertical portion
58 bulb
59 centrally disposed elliptical mirror
60 electrical cord
61 etched printed matter
62 electrical plug
63 infinity sign
64 electrical on/off switch
65 twenty-six letters of the alphabet
66 numbers 1 to 0
68 word "Positive"
70 word "Alpha"
72 word "Negative"
74 male and female sign joined in harmony
76 word "Omega"
78 copper or silver foiled colorful stained glass elliptical ring
80 first solder ring
82 copper or silver foiled colorful stained glass filler section
84 second solder ring
85 pair of filler section apertures
86 first stained glass insert
88 second stained glass insert
90 indicator portion rectangular body
92 indicator portion rectangular body rounded corners
94 indicator portion rectangular body lower surface
96 centrally disposed circular throughbore
98 four indicator portion body lower surface legs

DETAILED DESCRIPTION OF THE PREFERRED EMBODIMENT

Referring now to the figures in which like numerals indicate like parts, and particularly to FIG. 1, the occult device of the present invention is shown generally at 10 having a stationary box portion 12 and a movable indicator portion 14 that is movable on the stationary box portion 12 by the user hands 16 of a user 18.

The overall configuration of the stationary box portion 12 can best be seen in FIGS. 2–4 and 7, and as such, will be discussed with reference thereto.

The stationary box portion 12 includes an open-top hollow rectangular box 20 having a pair of box long sides 22, a pair of box short sides 24, a box closed bottom 26, and a box open top 28.

The open-top hollow rectangular box 20 is oak wood, is 19.25 inches long, is 15 inches wide, and is 3 inches high, but is not limited to that. The box closed bottom 26 of the open-top hollow rectangular box 20 is secured with screws, but is not limited to that.

Each of the pair of box long sides 22 of the open-top rectangular box 12 and each of the pair of box short sides 24 of the open-top rectangular box 12 has a box side inner surface 30, a box side outer surface 31, and a box side top 32.

The box side inner surface 30 of each of the pair of box long sides 22 of the open-top rectangular box 12 and of each of the pair of box short sides 24 of the open-top rectangular box 12 has a box recess 34 disposed in proximity to the box side top 32 of each of the pair of box long sides 22 of the open-top rectangular box 12 and in proximity to the box side top 32 of each of the pair of box short sides 24 of the open-top rectangular box 12.

The box recess 34 of the box side inner surface 30 of each of the pair of box long sides 22 of the open-top rectangular box 12 and of each of the pair of box short sides 24 of the open-top rectangular box 12 open into each other and further open into the box open top 28 of the open-top rectangular box 20 so as to form a box continuous ledge 36.

The rearmost one of the pair of box long sides 22 of the open-top rectangular box 12 has a box long side vertically disposed slot 37 disposed therethrough in proximity to one of the pair of box short sides 24 of the open-top rectangular box 12.

A light source arrangement 38 is disposed in the open-top rectangular box 12 and is mounted on the box side inner surface 30 of the rearmost one of the pair of box long sides 22 of the open-top rectangular box 12.

A first rectangular light transmitting sheet 40 is disposed in the box recess 34 of the box side inner surface 30 of each of the pair of box long sides 22 of the open-top rectangular box 12 and of each of the pair of box short sides 24 of the open-top rectangular box 12 and rests on the box continuous ledge 36 of the open-top rectangular box 12.

The first rectangular light transmitting sheet 40 is acrylic, is 18 inches long, is 14 inches wide, and is 0.25 inches thick, but is not limited to that.

A second rectangular light transmitting sheet 42 is disposed in the box recess 34 of the box side inner surface 30 of each of the pair of box long sides 22 of the open-top rectangular box 12 and of each of the pair of box short sides 24 of the open-top rectangular box 12 and rests on the first rectangular light transmitting sheet 40 which supports it.

The second rectangular light transmitting sheet 42 is 18 inches long, is 14 inches wide, and is 0.125 inches thick, but is not limited to that.

The first rectangular light transmitting sheet 40 and the second rectangular light transmitting sheet 42 close the box open top 28 of the open-top rectangular box 20.

An open-bottom open-top rectangular top frame 44 has a pair of top frame right angled long sides 46, a pair of top frame right angled short sides 48, a top frame open bottom 50, and a top frame open top 52. The open-bottom open-top rectangular top frame 44 is oak wood, but is not limited to that.

Each of the pair of top frame right angled long sides 46 of the open-bottom open-top rectangular top frame 44 and each of the pair of top frame right angled short sides 48 of the open-bottom open-top rectangular top frame 44 has a top frame horizontal portion 54 and a top frame vertical portion 56 extending perpendicularly downwardly from the top frame horizontal portion 54 of the open-bottom open-top rectangular top frame 44.

The open-bottom open-top rectangular top frame 44 is disposed on the open-top hollow rectangular box 20 with the top frame horizontal portion 54 of the open-bottom open-top rectangular top frame 44 resting on the box side top 32 of each of the pair of box long sides 22 of the open-top rectangular box 12 and of each of the pair of box short sides 24 of the open-top rectangular box 12 and with the top frame vertical portion 56 of the open-bottom open-top rectangular top frame 44 abutting the box side outer surface 31 of each of the pair of box long sides 22 of the open-top rectangular box 12 and of each of the pair of box short sides 24 of the open-top rectangular box 12. The open-bottom open-top rectangular top frame 44 is secured thereto by screws, but is not limited to that.

With the open-bottom open-top rectangular top frame 44 so secured, both the first rectangular light transmitting sheet 40 and the second rectangular light transmitting sheet 42 are secured in the box recess 34 of the box side inner surface 30 of each of the pair of box long sides 22 of the open-top rectangular box 12 and of each of the pair of box short sides 24 of the open-top rectangular box 12.

The configuration of the light source arrangement 38 can best be seen in FIG. 3, and as such, will be discussed with reference thereto.

The light source arrangement 38 includes a bulb 58. The bulb 58 of the light source arrangement 38 is a 10 inch, 120 volt, 7 watt Accent bulb, but is not limited to that.

An electrical cord 60 extends from the light bulb 58 through the vertically disposed box long side slot 37 of the rearmost one of the pair of box long sides 22 of the open-top rectangular box 12 and terminates in an electrical plug 62.

The electrical cord 60 contains an electrical on/off switch 64 that is disposed external to the open-top rectangular box 12 and in proximity to the vertically disposed box long side slot 37 of the rearmost one of the pair of box long sides 22 of the open-top rectangular box 12.

The electrical on/off switch 64 controls power from a 120 volt power source (not shown) that is in electrical communication with the electrical plug 62. When the electrical on/off switch 64 is closed, power from the power source (not shown) passes through the electrical cord 60, enters the light bulb 58, and illuminates same.

The configuration of the second rectangular light transmitting sheet 42 can best be seen in FIGS. 4 and 7, and as such, will be discussed with reference thereto.

The second rectangular light transmitting sheet 42 includes a centrally disposed elliptical mirror 59. The centrally disposed elliptical mirror 59 of the second rectangular light transmitting sheet 42 has etched printed matter 61 disposed thereon so that when the bulb 58 of the light source arrangement 38 is illuminated, the etched printed matter 61 of the centrally disposed elliptical mirror 59 of the second rectangular light transmitting sheet 42 becomes visible.

The etched printed matter 61 of the centrally disposed elliptical mirror 59 of the second rectangular light transmitting sheet 42 includes an infinity sign 63, the twenty-six letters of the alphabet 65, the numbers 1 to 0 66, a word "Positive" 68, a word "Alpha" 70, a word "Negative" 72, a male and female sign joined in harmony 74, and a word "Omega" 76.

Surrounding the centrally disposed elliptical mirror 59 of the second rectangular light transmitting sheet 42 is a copper foiled colorful stained glass elliptical ring 78 that is concentrically attached to the centrally disposed elliptical mirror 59 of the second rectangular light transmitting sheet 42 by a first solder ring 80.

The first solder ring 80 of the second rectangular light transmitting sheet 42 is thicker than the centrally disposed elliptical mirror 59 of the second rectangular light transmitting sheet 42 so that the first solder ring 80 of the second rectangular light transmitting sheet 42 rests on the first rectangular light transmitting sheet 40 and the centrally disposed elliptical mirror 59 of the second rectangular light transmitting sheet 42 is displaced a distance above the first rectangular light transmitting sheet 40.

A copper foiled colorful stained glass filler section 82 is attached to the copper or silver foiled colorful stained glass elliptical ring 78 of the second rectangular light transmitting sheet 42 by a second solder ring 84. The copper or silver foiled colorful stained glass filler section 82 of the second rectangular light transmitting sheet 42 fills in the remaining space of the second rectangular light transmitting sheet 42.

The second solder ring 84 of the second rectangular light transmitting sheet 42 is substantially as thick as the first solder ring 80 of the second rectangular light transmitting sheet 42 and also rests on the first rectangular light transmitting sheet 40.

The copper foiled colorful stained glass filler section 82 of the second rectangular light transmitting sheet 42 has a pair of filler section apertures 85. A first stained glass insert 86, having a moon etched thereon so that when the bulb 58 of the light source arrangement 38 is illuminated the etched moon becomes visible, fills one of the pair of filler section apertures 85 of the copper foiled colorful stained glass filler section 82 of the second rectangular light transmitting sheet 42.

A second stained glass insert 88, having a sun etched thereon so that when the bulb 58 of the light source arrangement 38 is illuminated the etched sun becomes visible, fills another one of the pair of filler section apertures 85 of the copper foiled colorful stained glass filler section 82 of the second rectangular light transmitting sheet 42.

The configuration of the movable indicator portion 14 can best be seen in FIGS. 5–7, and as such, will be discussed with reference thereto.

The movable indicator portion 14 includes an indicator portion rectangular body 90 that has indicator portion rectangular body rounded corners 92 and an indicator portion rectangular body lower surface 94. The movable indicator portion 14 is acrylic, is 6 inches long, is 4 inches wide, is 0.0625 inches thick, and is jeweled, but is not limited to that.

The indicator portion rectangular body 90 of the movable indicator portion 14 has a centrally disposed circular throughbore 96 so that when the bulb 58 of the light source arrangement 38 is illuminated the etched printed matter 61 of the centrally disposed elliptical mirror 59 of the second rectangular light transmitting sheet 42 is visible through the centrally disposed circular throughbore 96 of the indicator portion rectangular body 90 of the movable indicator portion 14.

The centrally disposed circular throughbore 96 of the indicator portion rectangular body 90 of the movable indicator portion 14 is 1 inch in diameter, but is not limited to that.

Extending downwardly from the indicator portion rectangular body lower surface 94 of the indicator portion rectangular body 90 of the movable indicator portion 14 is four indicator portion body lower surface legs 98. Each of the four indicator portion body lower surface legs 98 of the indicator portion rectangular body lower surface 94 of the indicator portion rectangular body 90 of the movable indicator portion 14 is circular, is 0.5 inches in diameter, and is 0.125 inches high, but is not limited to that.

As shown in FIG. 7, it is imperative to understand that since the first solder ring 80 of the second rectangular light transmitting sheet 42 is thicker than the centrally disposed elliptical mirror 59 of the second rectangular light transmitting sheet 42, on which the movable indicator portion 58 moves, the boundary of movement of the movable indicator portion 58 is defined so that the movable indicator portion 58 can not unintentionally fall off the occult device 10.

In operation, one to four persons sit in the proper setting, that is, in a quiet dark room with a little music and candlelight. Any believer with a little patience can receive not only answers to questions but may also solve problems, break creative blocks, or gain self confidence to perform stressful or difficult tasks.

With the bulb 58 illuminated to make the printed matter 61 of the centrally disposed elliptical mirror 59 of the second rectangular light transmitting sheet 42, the first stained glass insert 86, and the second stained glass insert 88 visible and to set the mood, the participants place their finger tips lightly on the movable indicator portion 14. With a little faith each believer's inner psychic is open to receive inquiries or requests.

As each person asks questions or requests needed help, the movable indicator portion 14 mysteriously moves around the centrally disposed elliptical mirror 59 of the second rectangular light transmitting sheet 42 to seek out the answers.

A move to the infinity sign 65 of the etched printed matter 61 of the centrally disposed elliptical mirror 59 of the second rectangular light transmitting sheet 42 indicates an unanswerable question.

A move to the word "Positive" 68 of the etched printed matter 61 of the centrally disposed elliptical mirror 59 of the second rectangular light transmitting sheet 42 indicates a yes answer.

A move to the word "Negative" 72 of the etched printed matter 61 of the centrally disposed elliptical mirror 59 of the second rectangular light transmitting sheet 42 indicates a no answer.

It will be understood that each of the elements described above, or two or more together, may also find a useful application in other types of constructions differing from the types described above.

While the invention has been illustrated and described as embodied in an occult, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An occult device, comprising:

a) an open-top hollow rectangular box having a pair of long sides, a pair of short sides, a closed bottom, and an open top; a rearmost one of said pair of long sides of said open-top rectangular box having a vertically disposed slot disposed therethrough in proximity to a one of said pair of short sides of said open-top rectangular box;

b) a light source disposed in said open-top hollow rectangular box; said light source being a 120 volt 7 watt light bulb;

c) a first light transmitting sheet disposed on said open top of said open-top hollow rectangular box, so that light from said light source can be transmitted therethrough;

d) a second light transmitting sheet disposed on said open top of said open-top hollow rectangular box and supported by said first light transmitting sheet, so that light from said light source can be transmitted therethrough, said first light transmitting sheet and said second light transmitting sheet closing said open top of said open-top hollow rectangular box; said second rectangular light transmitting sheet including a centrally disposed elliptical mirror; said centrally disposed elliptical mirror of said second rectangular light transmitting sheet having etched printed matter disposed thereon, so that when said light bulb is illuminated said etched printed matter of said centrally disposed elliptical mirror of said second rectangular light transmitting sheet becomes visible;

e) an indicator movable on said second light transmitting sheet by the hands of a user; and f) an electrical cord extending from said light bulb through said vertically disposed slot in said rearmost one of said pair of long sides of paid open-top rectangular box; said electrical cord terminating in an electrical plug; said electrical cord containing an electrical on/off switch disposed external to said open-top rectangular box and in proximity to said vertically disposed slot in said rearmost one of said pair of long sides of said open-top rectangular box, so that power from a 120 volt power source can be controlled and when said electrical on/off switch is closed power from the power source passes through said electrical cord and illuminates said light bulb.

2. The device as defined in claim 1, wherein said open-top hollow rectangular box is oak wood.

3. The device as defined in claim 1, wherein each of said pair of long sides of said open-top rectangular box and each of said pair of short sides of said open-top rectangular box has an inner surface, an outer surface, and a top.

4. The device as defined in claim 3, wherein said inner surface of each of said pair of long sides of said open-top rectangular box and of each of said pair of short sides of said open-top rectangular box has a recess disposed in proximity to said top of each of said pair of long sides of said open-top rectangular box and in proximity to said top of each of said pair of short sides of said open-top rectangular box, said recess of said inner surface of each of said pair of long sides of said open-top rectangular box and of each of said pair of short sides of said open-top rectangular box in communication with each other and open into said open top of said open-top rectangular box so as to form a continuous ledge.

5. The device as defined in claim 1, wherein said light source is mounted on said inner surface of said rearmost one of said pair of long sides of said open-top rectangular box.

6. The device as defined in claim 4, wherein said first rectangular light transmitting sheet is disposed in said recess of said inner surface of each of said pair of long sides of said open-top rectangular box and of each of said pair of short sides of said open-top rectangular box and rests on said continuous ledge of said open-top rectangular box.

7. The device as defined in claim 1, wherein said first rectangular light transmitting sheet is acrylic.

8. The device as defined in claim 6, wherein said second rectangular light transmitting sheet is disposed in said recess of said inner surface of each of said pair of long sides of said open-top rectangular box and of each of said pair of short sides of said open-top rectangular box and rests on said first rectangular light transmitting sheet.

9. The device as defined in claim 3; further comprising an open-bottom open-top rectangular top frame that has a pair of right angled long sides, a pair of right angled short sides, an open bottom, and an open top, each of said pair of right angled long sides of said open-bottom open-top rectangular top frame and each of said pair of right angled short sides of said open-bottom open-top rectangular top frame has a horizontal portion and a vertical portion that extends perpendicularly downwardly from said horizontal portion of said open-bottom open-top rectangular top frame.

10. The device as defined in claim 9, wherein said open-bottom open-top rectangular top frame is oak wood.

11. The device as defined in claim 9, wherein said open-bottom open-top rectangular top frame is disposed on said open-top hollow rectangular box with said horizontal portion of each of said pair of right angled long sides of said open-bottom open-top rectangular top frame and each of said pair of right angled short sides of said open-bottom open-top rectangular top frame resting on said top of each of said pair of long sides of said open-top rectangular box and of each of said pair of short sides of said open-top rectangular box and with said vertical portion of each of said pair of right angled long sides of said open-bottom open-top rectangular top frame and each of said pair of right angled short sides of said open-bottom open-top rectangular top frame abutting said outer surface of each of said pair of long sides of said open-top rectangular box and of each of said pair of short sides of said open-top rectangular box, so that both said first rectangular light transmitting sheet and said second rectangular light transmitting sheet are secured in said recess of said inner surface of each of said pair of long sides of said open-top rectangular box and of each of said pair of short sides of said open-top rectangular box.

12. The device as defined in claim 1, wherein said etched printed matter of said centrally disposed elliptical mirror of said second rectangular light transmitting sheet includes an infinity sign, the twenty-six letters of the alphabet, the numbers 1 to 0, the word "Positive", the word "Alpha", the word "Negative", a male and female sign joined in harmony, and the word "Omega".

13. The device as defined in claim 1, wherein said second rectangular light transmitting sheet further includes a copper foiled colorful stained glass elliptical ring that is concentrically attached to, and surrounds, said centrally disposed elliptical mirror of said second rectangular light transmitting sheet by a first solder ring, said first solder ring of said second rectangular light transmitting sheet is thicker than said centrally disposed elliptical mirror of said second rectangular light transmitting sheet, so that said first solder ring of said second rectangular light transmitting sheet rests on said first rectangular light transmitting sheet and said centrally disposed elliptical mirror of said second rectangular light transmitting sheet is displaced a distance above said first rectangular light transmitting sheet and since said first solder ring of said second rectangular light transmitting sheet is thicker than said centrally disposed elliptical mirror of said second rectangular light transmitting sheet, on which said movable indicator moves, the boundary of movement of said movable indicator is defined preventing said movable indicator from unintentionally falling off said occult device.

14. The device as defined in claim 13, wherein said second rectangular light transmitting sheet further includes a selected from the group consisting of silver and copper foiled colorful stained glass filler section attached to said foiled colorful stained glass elliptical ring of said second rectangular light transmitting sheet by a second solder ring, said foiled colorful stained glass filler section of said second rectangular light transmitting sheet fills in the remaining space of said second rectangular light transmitting sheet, said second solder ring of said second rectangular light transmitting sheet is substantially as thick as said first solder ring of said second rectangular light transmitting sheet and also rests on said first rectangular light transmitting sheet, said foiled colorful stained glass filler section of said second rectangular light transmitting sheet has a pair of apertures.

15. The device as defined in claim 14, wherein said foiled colorful stained glass filler section of said second rectangular light transmitting sheet further has a first stained glass insert that fills one of said pair of filler section apertures of said foiled colorful stained glass filler section of said second rectangular light transmitting sheet, said first stained glass insert of said foiled colorful stained glass filler section of said second rectangular light transmitting sheet has a moon etched thereon, so that when said light bulb is illuminated said etched moon becomes visible, said foiled colorful stained glass filler section of said second rectangular light transmitting sheet further has a second stained glass insert that fills another one of said pair of filler section apertures of said foiled colorful stained glass filler section of said second rectangular light transmitting sheet, said first stained glass insert of said foiled colorful stained glass filler section of said second rectangular light transmitting sheet has a sun etched thereon, so that when said light bulb is illuminated said etched sun becomes visible.

16. The device as defined in claim 15, wherein said movable indicator includes a substantially rectangular body that has rounded corners, a lower surface, four legs that extend downwardly from said lower surface of said rectangular body of said movable indicator, and a centrally disposed circular throughbore, so that when said light bulb is illuminated said etched printed matter of said centrally disposed elliptical mirror of said second rectangular light transmitting sheet is visible through said centrally disposed circular throughbore of said substantially rectangular body of said movable indicator.

* * * * *